US006689424B1

(12) United States Patent
Wang et al.

(10) Patent No.: US 6,689,424 B1
(45) Date of Patent: Feb. 10, 2004

(54) SOLID LUBRICANT COATINGS PRODUCED BY THERMAL SPRAY METHODS

(75) Inventors: You Wang, Storrs, CT (US); Tongsan D. Xiao, Willington, CT (US); Hui Ye, St. Louis Park, MN (US)

(73) Assignee: Inframat Corporation, North Haven, CT (US)

( * ) Notice: Subject to any disclaimer, the term of this patent is extended or adjusted under 35 U.S.C. 154(b) by 0 days.

(21) Appl. No.: 09/579,874

(22) Filed: May 27, 2000

Related U.S. Application Data

(63) Continuation-in-part of application No. 09/485,424, filed as application No. PCT/US99/12899 on Jun. 9, 1999.
(60) Provisional application No. 60/136,495, filed on May 28, 1999.

(51) Int. Cl.[7] ..... C23C 4/06
(52) U.S. Cl. ..... 427/456; 427/455
(58) Field of Search ..... 427/450, 451, 427/453, 455, 456, 242, 215, 216

(56) References Cited

U.S. PATENT DOCUMENTS

| | | | | |
|---|---|---|---|---|
| 3,332,753 | A | 7/1967 | Batchelor et al. | |
| 3,694,266 | A | 9/1972 | Bergum et al. | |
| 3,770,505 | A | 11/1973 | Bergum et al. | |
| 3,802,893 | A | 4/1974 | Kiger et al. | 106/62 |
| 3,890,686 | A | 6/1975 | Caubet, et al. | |
| 3,907,589 | A | 9/1975 | Gay et al. | 136/6 R |
| 4,013,818 | A | 3/1977 | Askew et al. | 429/112 |
| 4,119,769 | A | 10/1978 | Schneider et al. | |
| 4,141,743 | A | 2/1979 | Grubba et al. | 106/66 |
| 4,675,257 | A | 6/1987 | Winchester | |
| 4,731,307 | A | 3/1988 | Guidotti | 429/112 |
| 4,840,859 | A | 6/1989 | Williams et al. | |
| 4,869,936 | A | 9/1989 | Moskowitz et al. | |
| 4,881,951 | A | 11/1989 | Wood et al. | 51/309 |
| 5,059,095 | A | 10/1991 | Kushner et al. | 416/241 |
| 5,080,056 | A | 1/1992 | Kramer et al. | |
| 5,158,843 | A | 10/1992 | Batson et al. | |
| 5,198,308 | A | 3/1993 | Shetty et al. | |
| 5,254,415 | A | 10/1993 | Williams et al. | 429/153 |
| 5,271,967 | A | 12/1993 | Kramer et al. | |
| 5,312,653 | A | 5/1994 | Buchanan | |
| 5,328,763 | A | 7/1994 | Terry | |
| 5,332,422 | A | 7/1994 | Rao | |
| 5,426,003 | A | 6/1995 | Spengler et al. | |
| 5,484,662 | A | 1/1996 | Rao | |
| 5,498,269 | A | 3/1996 | Larmie | 51/295 |
| 5,498,484 | A | 3/1996 | Duderstadt | 428/633 |
| 5,530,050 | A | 6/1996 | Rangaswamy | 524/430 |
| 5,554,456 | A | 9/1996 | Ovshinsky et al. | |
| 5,651,801 | A | 7/1997 | Monroe et al. | 51/309 |
| 5,669,941 | A | 9/1997 | Peterson | 51/295 |
| 5,716,422 | A | 2/1998 | Muffoletto et al. | |
| 5,763,106 | A | 6/1998 | Blanchard et al. | |
| 5,840,440 | A | 11/1998 | Ovshinsky et al. | |
| 6,025,034 | A | 2/2000 | Strutt et al. | 427/450 |
| 6,162,530 | A | 12/2000 | Xiao et al. | 428/292.1 |
| 6,210,832 | B1 | 4/2001 | Visco et al. | 429/218.1 |
| 6,252,762 | B1 | 6/2001 | Amatucci | 361/503 |

FOREIGN PATENT DOCUMENTS

| | | |
|---|---|---|
| WO | WO 97/18341 | 5/1997 |
| WO | 99/64641 | * 12/1999 |

OTHER PUBLICATIONS

"Alternatives to Composite Cathodes", ARPA Battery Workshop, Leesburg, VA, Apr. 25, 1995, Christopher J. Crowley and Patrick J. Magari, Creare, Inc. Hanover, New Hampshire.

(List continued on next page.)

*Primary Examiner*—Katherine A. Bareford
(74) *Attorney, Agent, or Firm*—Cantor Colburn LLP

(57) ABSTRACT

A method for the deposition of solid lubricant coatings onto a substrate, comprising thermally spraying a powder comprising agglomerates of a solid lubricant coated with sulfur. Preferably, the solid lubricant is a sulfide. The coatings find particular utility on rollers used in the manufacture of steel.

21 Claims, 3 Drawing Sheets

OTHER PUBLICATIONS

U.S. patent application Ser. No. 09/795,696, Dai, et al., filed Feb. 28, 2001.
U.S. patent application Ser. No. 09/432,334, Guidotti, et al., filed Nov. 2, 1999.
U.S. patent application Ser. No. 09/485,424, Hui, et al., filed Feb. 8, 2000.
T.D. Xiao, et al. "Nanostructured Feedstock for Thermal Spray Applications" Fine, Ultrafine and Nano Powders. pp 1–11 Oct. 17–22, 1999.
B.H. Kear, et al. "Nanostructures: The Next Generation of High Performance Bulk Materials and Coatings"0 Naval Research Reviews. Office of naval Research. Four/1994 vol. XLVII (no month date).
Metals Han dbook, Ninth Edition: vol. 5 Suface Cleaning, Finishing and Coating. American Society for Metals. 1982. pp. 364–365 (no month date).
Reisner, D.E., et al. "Thermal–Sprayed Thin Cathodes for Thermal Battery," Journal of New Materials for Electochemical Systems, 2, 279–283 (1999). (no month date).
T.D. Xiao, et al. "Thermal Spray of Nanostructured Ceramic Coatings for Improved Mechanical Properties". Procs. 12th Intl. Surface Modicication conf., Columbus, OH, Oct. 15, 1998.
R.C. Weast, et al. CRC Handbook of Chemistry and Physics, 66th Eds. , 1985–1986 (CRC press, Boca Raton, florida), PP. B104 (no month date).
T.D. Xiao and P.R. Strutt "Inframat's Nanostrucutred Materials Technologies: Thermal Spray Feedstocks, Ready–to Press Powders, and Environmental Materials, " Procs. Fine, Ultrafine and Nano Powders 98, New York, NY, Nov. 8–10, 1998.
H.E. Sliney, "A New Chromium Carbide–Based Tribological Coating for Use to 900C with Particular Reference to the Stirling engine," J. vac. Sci. Tech. A, 4 (1986), 2629–2632. (no month date).

M. Suzuki, "Comparison of Tribological Charaterisitics of Sputtered MoS2 Films Coated with Different Apparatus," Wear, 218 (1998), pp. 110–118 (no month date).

Dowa Mining Co., Ltd., website,//www.dowa.co.jp/ (no date).

K.J. Wahl, M. Belin and I.L. Singer, "A Triboscopic Investigation of the Wear and Friction of MoS2 in A Reciprocation Sliding Contact," Wear, 214 (1998), pp. 212–220 (no month date).

T. Spalvins, "Areview of recent advances insolid film lubrication," J. Vac. Sci. Technol. A., 5 (1987), pp. 212–219 (no month date).

Zhauang, et al. "Microstructure and tribological properties of sulphide coating produced by ion sulphuration", Wear 225–229 (1999) 799–805 (no month date).

Ning, et al. "Wear mechanism of ion–sulphurization layer on steel under dry conditions", Wear 247 (2001) 1–8 (no month date).

* cited by examiner

SOLID LUBRICANT COATINGS PRODUCED BY THERMAL SPRAY METHODS

CROSS-REFERENCE TO RELATED APPLICATIONS

This invention claim priority to U.S. application Ser. No. 60/136,495, filed May 28, 1999, and is a continuation-in-part of U.S. application Ser. No. 09/485,424, filed Feb. 8, 2000 which is a U.S. National stage application of PCT application PCT/US99/12899 filed on Jun. 9, 1999. These applications are incorporated herein by reference in their entirety.

BACKGROUND OF THE INVENTION

1. Field of the Invention

The present invention relates to solid lubricants and methods for forming self-lubricating coatings. More particularly, the present invention relates to self-lubricating coatings which reduce the friction and wear of components or parts, such as piston rings, cylinder liners, gears, heavy duty rear axle spiders, and rollers, especially, parts working under difficult lubrication conditions.

2. Brief Description of the Related Art

It is well known that surface characteristics play an important role in friction and wear processes, and that the most important reason for using lubricants is to reduce friction. Oils are commonly used lubricants, coating surfaces to reduce friction, thereby allowing surfaces to slide more easily and reducing wear. However, the number of machines and mechanisms working in extreme conditions increases every year, and oil is not generally suitable for use under these conditions. To address the problems associated with movable joints in a vacuum, in low and high temperatures, and for the successful operation of tribotechnical units in these conditions, it is necessary to develop alternative lubrication materials and methods.

Alternatives which have been developed for use at elevated temperatures include solid lubricants such as molybdenum disulfide and graphite. Various self-lubricating, solid, composite coating materials have been developed at NASA. In one; (PS200), chromium carbide serves as a tough, wear-resistant matrix, while silver particles provide lubrication at low temperatures and a barium fluoride/calcium fluoride eutectic phase provides lubrication at higher temperatures.

Sulfur is an important component in many organic and inorganic lubricants, providing unique lubricity and passivating characteristics against mechanical or chemical attack on surfaces. Some studies have shown that a monolayer of strongly chemisorbed atoms, such as may be found in sulfur, can act as a lubricant, significantly decreasing the friction coefficient of the surface. Without being bound by theory, the good lubricating properties of sulfur compounds may therefore derive from the strong sulfur-metal bonds formed at the surface. During mechanical contact, sulfur overlayers can thus prevent the formation of metal-metal bonds between the contacting bodies. Therefore, for thin solid lubricant films, the friction coefficient can be remarkably stable, despite the fact that much of the sulfide coating is worn early in the life of the contact. Because of its low melting point, and because of its layer lattice (hexagonal crystal structure) crystal structures, sulfur furthermore has good lubricating properties especially in a vacuum.

A low temperature sulfurizing method is currently used in industries in, e.g., Japan, France, India and China. This method (which is called Sulf-BT process or Caubet process, available under license from HEF France) is an anodic sulfurization performed in a suitable molten bath. It forms a thin (a few microns thick) pyrrothite ($Fe_{1-x}S$, a metal-deficient iron sulfide) film on steel. The method can be used for various irons and steels being characterized as low-temperature, rapid, and with no dangers of hydrogen embrittlement.

However, almost all of the bath compositions used for Sulf-BT process contain at least one harmful substance, such as NaCNS, KNCS, and KCN. The Sulf-BT process can furthermore generates harmful gases or liquids, even at operation temperatures of below 200° C. After sulfurizing, the parts or specimens have to be rinsed in running water to dissolve the frozen salt crust, potentially producing a hazardous waste stream, ands sulfurized parts or samples are easily corroded by retained salt if rinsing is not thorough. The molten salt loses efficacy after few cycles, and the waste salt, which may also be hazardous, is difficult to regenerate efficiently. Finally, the Sulf-BT process is not suitable for steel having a chromium content higher than 12%, or for other, nonferrous metals.

Molybdenum disulfide ($MoS_2$) may be applied to surfaces as a solid lubricant by a number of methods, including simple rubbing or burnishing, air spraying of resin-bonded or inorganically bonded coating, and more recently, physical vapor deposition (PVD) techniques as sputtering. Burnished films are the easiest and least expensive to apply, but have very limited wear life. Resin-bonded spray coatings, especially the heat-cured variety, have good wear life and are frequently used in ordinary air environments. They are typically 5 to 15 microns thick. Their coefficient of friction depends on humidity and sliding conditions, as well as the binder material used.

The friction coefficients for sputtered $MoS_2$ is about 0.01 to 0.15. However, the sputtered films are very thin, usually 0.1 microns to 1.5 microns, because thicker films require longer sputtering times. The sputtering apparatus is generally very expensive and the cost of production is high. Some workers have shown that the durability of the $MoS_2$ films depended largely on the type of sputtering apparatus used.

Formation of solid lubricant coatings by thermal spray processes has been disclosed in U.S. Pat. Nos. 5,763,106, 5,332,422 and 5,484,662. U.S. Pat. No. 5,763,106 discloses thermal spray of composite powder containing a ceramic, metal and lubricant. In U.S. Pat. Nos. 5,332,422 and 5,484,662, the powders for thermal spray comprise agglomerates of two more solid lubricant particles, together with fusible metal particles such as steel, bound together with a binder such as wax. The lubricant particles may further be coated with a metal such as copper.

Pure sulfide coatings (i.e., comprising only lubricant) have heretofore not been available by thermal spray, as sulfide self-lubricants are thermally unstable. The extremely high temperature zone of plasma gun would thus be expected to result in decomposition and oxidation of the sulfide-based lubricant. A need exists, therefore, for materials and methods for the production of sulphide-based lubricating coatings by thermal spray methods.

SUMMARY OF THE INVENTION

The above-described drawbacks and disadvantages are solved or alleviated by the present process, comprising thermal spray of agglomerates of sulfur-coated lubricant particles. The sulfur coating acts as a binder for the particles, and prevents thermal decomposition of the lubricant particles during the spraying process. The advantages of using thermal spray techniques are that the process is environmentally benign, low cost, east to operate, and leaves no corrosion from residual salts. Thermal spray also offers versatility, e.g., large parts are easy to spray, and a wide variety of substrates may be sprayed. Thermal spray methods are also readily adaptable to continuous manufacturing processes. In another advantageous feature, the lubricants may comprise nanostructured materials, which after thermal spray results in coatings having nanostructured coatings.

BRIEF DESCRIPTION OF THE INVENTION

The invention is further limited by thee following non-limiting FIGURES, wherein.

DETAILED DESCRIPTION OF THE PREFERRED EMBODIMENTS

Figure 1:
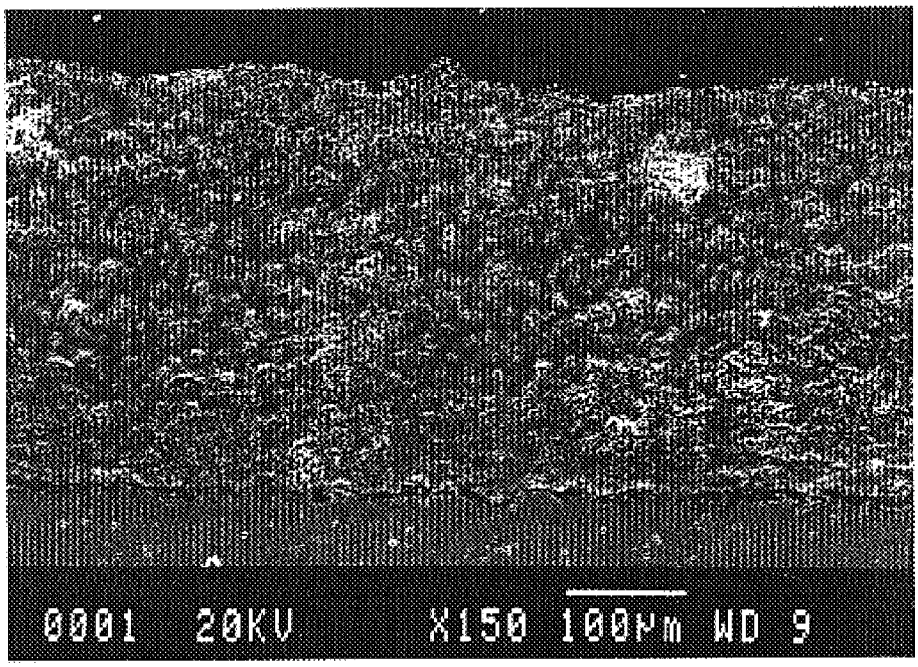
FIG. 1 is an SEM photograph of the cross-section of an FeS coating manufactured by the method of the present invention.

In accordance with the present method, self-lubricating coatings may be produced by thermal spray techniques, wherein the powders for thermal spray comprise lubricant particles coated with sulfur. Thermal spray, and in particular plasma spray techniques, are advantageous in that the morphology and phase of the coating can be controlled, as well as the deposit thickness of the coating. Thus, very thin films (e.g., as thin as 1 micron) are available, up to reasonably thick films (e.g., up to 1, and even up to 10 millimeters). Films in the range of about 1 to about 300 microns thick are readily produced, and films in the range of about 20 to about 150 microns are particularly useful.

Thermal spray methods involve heating feedstock particles to a molten or plastic state, and propelling the heated particles onto a substrate to form a coating. Methods and apparatus for thermal spray are well known, being described, for example, in U.S. Pat. Nos. 4,869,936, 5,080,056, 5,198,308, 5,271,967, 5,312,653, and 5,328,763, which are incorporated by reference herein. However, a number of lubricant coatings, particularly sulfide-based coatings, have not been previously accessible by thermal spray, because they decompose at the temperatures required to tansform the feedstock particles to a molten or plastic state, or are converted to forms which are unsuitable for use as lubricants.

Coating the lubricant particles comprises mixing a quantity of sulfur effective to suppress thermal decomposition with the lubricant particles. The sulfur and the particles is mixed using methods known in the art until each component is uniformly dispersed. The sulfur-coated lubricant powders for thermal spray are most conveniently prepared by ball milling the lubricant particles with elemental sulfur, or with precursors that give rise to elemental sulfur during ball milling. The coated particles are then dried, for example at 50–180° C. for 2 to 24 hours before spraying. If necessary, in order to achieve the appropriate size for thermal spraying, the agglomerated particles are crushed, ball milled (to make the particle flowable), and sieved to yield agglomerates having maximum diameters from about 10 to about 300 microns, preferably about 10 to about 50 microns, and most preferably about 10 to about 25 microns. Other binders known in the art may be added during ball milling, such as wax. Additional benefits of the sulfur coating include much better flowability of the reprocessed powder and the ability to store the powder outside of a vacuum.

Suitable lubricants useful in the present process can be selected from known solid lubricants, including but not being limited to carbonaceous materials such as graphite; sulfides, including $FeS_2$, FeS, $MoS_2$, and $WS_2$; certain metal oxides, especially transition metal oxides such as iron oxide and chromium oxide; and mixtures and alloys comprising at least one of the foregoing, including composites. Other additives may be present, including carbonaceous materials, starch, and low-melting metals such as copper.

In another particularly advantageous feature, the lubricant particles comprise nanostructured materials which, after thermal spray, results in nanostructtured coatings. As used herein "nanostructured" materials refers to materials having a grain size on the order of 1 to 100 nanometers (where 1 nm=10 angstroms). Nanostructured materials are thus characterized by having a high fraction of the material's atoms residing at grain or particle boundaries. For example, with a grain size in the five nanometer range, about one-half of the atoms in a nanocrystalline or a nanophase solid reside at grain or particle interfaces. Rapid interaction between the active materials and its surroundings are possible because of high surface area of the nanostructured materials. Therefore, the materials could sustain high current charging and discharging conditions.

Thermal spraying processes for use with the present invention are well known in the art. Known spraying processes may be classified into two groups, namely, chemical combustion spraying processes and electric heating spraying processes. Chemical combustion spraying processes include powder flame spraying, wire/rod flame spraying, high velocity oxygen fuel (HVOF) flame spraying, oxygen acetylene torch spraying, HVAF, and detonation/explosive flame spraying. Electrical heating spraying processes include electric-arc or twin-wire arc spraying and plasma spraying. Apparatus for thermal spray by the above processes are known.

A particular advantage of the present method is that a wide variety of substrates may be coated, including but not limited to ferrous metals such as steels, cast irons, and the like; nonferrous metals, such as aluminum, titanium, and the like; alloys based on nickel, cobalt, aluminum, titanium, and the like; ceramics such as $Si_3N_4$, SiC, $Al_2O_3$, $Cr_2O_3$, $ZrO_2$, BN, TiC, TiN, WC, WC/Co, and the like; carbonaceous materials such as diamond; and hard, high temperature plastics. Coated substrates may also be used, thereby forming multiple layer coatings.

The formed coatings may be porous, i.e, having a porosity of from about 5 to about 30% by volume.

The coatings manufactured by the above-described process find particular utility in coating the rollers used during the manufacture of steel. In a typical steel mill manufacturing environment, a complete production may consist of approximately 600 rollers. Each bar for bar feedstock measures about 7 inches×7 inches×50 feet. Using transfer rollers, the bar feedstock is loaded into one end of a furnace and is heated for about 90 minutes to 2,000° F. before it is ejected into the bar mill line at a rate of about 1 bar per minute. In the bar mill line, a roughing mill first reduces the cross section of the bar by about 1" in both directions, using large vertical and horizontal pressing rollers (12-inch diameter). A series of intermediate mills reduce the bar stock to an approximately 1-inch cross section. Typical lifetimes for rollers are 1 month. A subsequent firming mill (Kock's Mill) changes the shape from rectangular to round and back to rectangular to increase strength. Once the rod stock is reduced to about ¾ inch, the long rod (thousands of feet) is collected on a mandrel in a pouring tub and wound into cores for shipping. The customer then reheats the core and cuts short lengths for applications such as small axles and motor armatures. Methods for lubricating the rollers used in these processes would enhance the lifetime of the rollers, and thus decrease the costs of steel manufacture.

The invention is further illustrated by the following non-limiting examples.

EXAMPLE 1

1,000 g of FeS was blended with 100 g of 100-mesh sulfur powder. The powder was mixed and ball milled in a milling jar for 24 hours with alumina milling media. The milled powder was placed in the vacuum oven, heated to 120° C. for 24 hours and then cooled to room temperature under vacuum. The cooled powder was then crushed, ball milled to make the particles flowable (i.e., remove the sharp edges from the crushed powder) and sieved to yield agglomerates of sulfur-coated particles, wherein the agglomerates have an average diameter of about 15 microns.

304 stainless steel was selected as the substrate for spraying, and was first ultrasonically cleaned in alcohol. The cleaned substrate was then grit blasted.

The agglomerated powder mixture was then fed into a Metco 9MB-plasma spray gun. The thickness of the coating could be controlled by the spray cycles. As shown in FIG. 1, a pure FeS coating results. XRD analysis further shows the composition of the coating to be 100% pure FeS.

Figure 2:
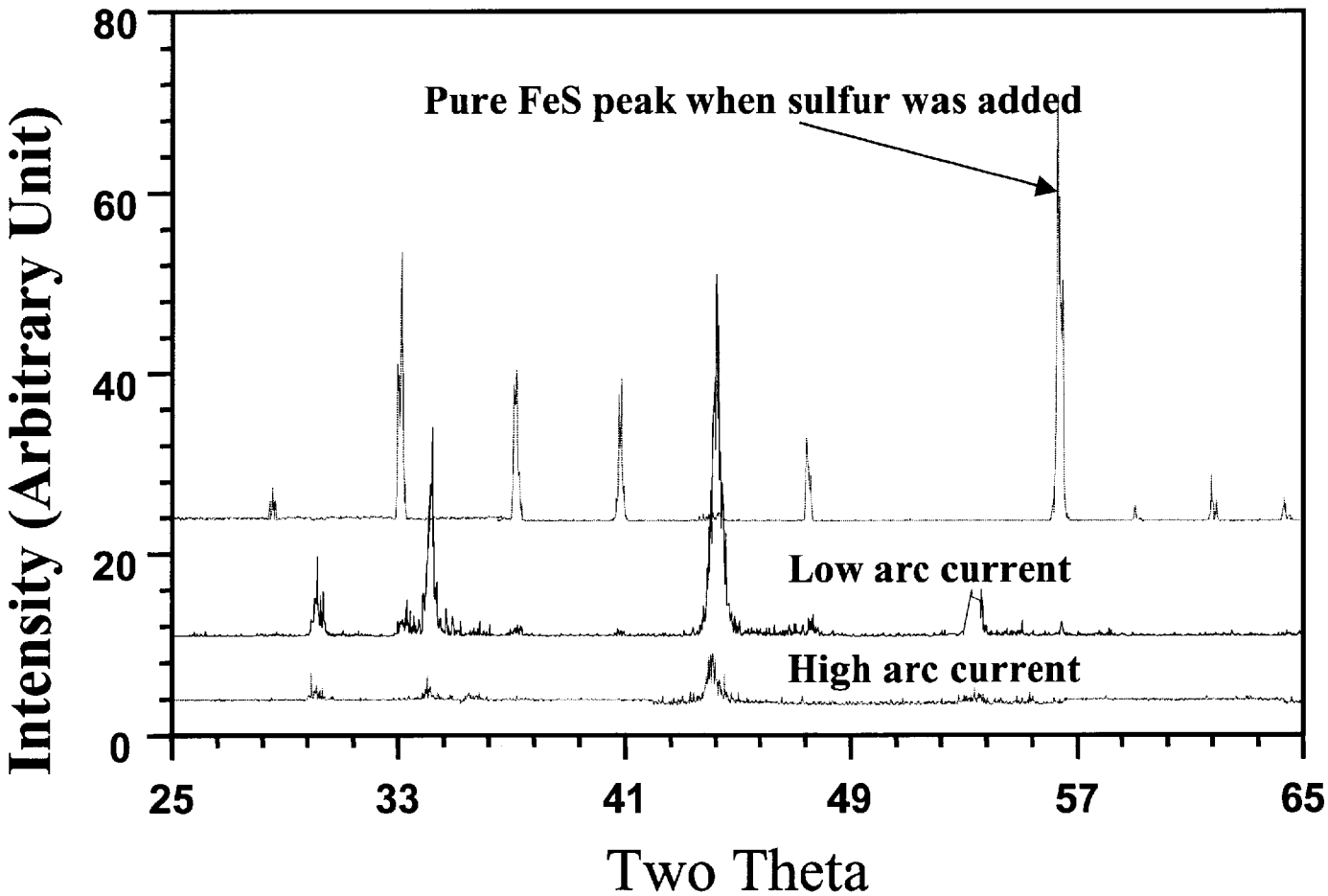
FIG. 2 is an XRD spectrum of the coating of FIG. 1.
Figure 3:
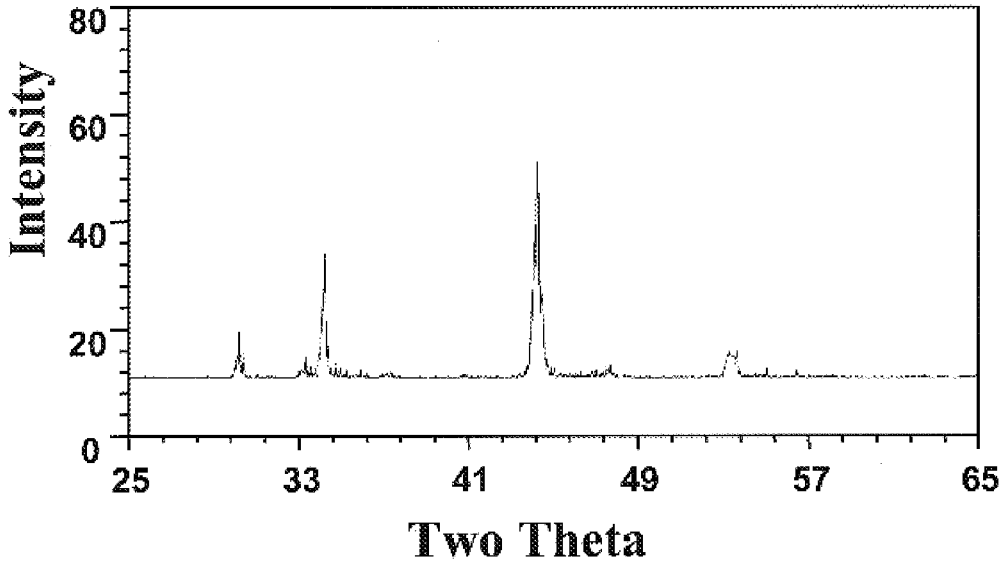
FIG. 3 is a comparative XRD spectrum of two different sulfur-based coatings of the present invention.
Figure 4:
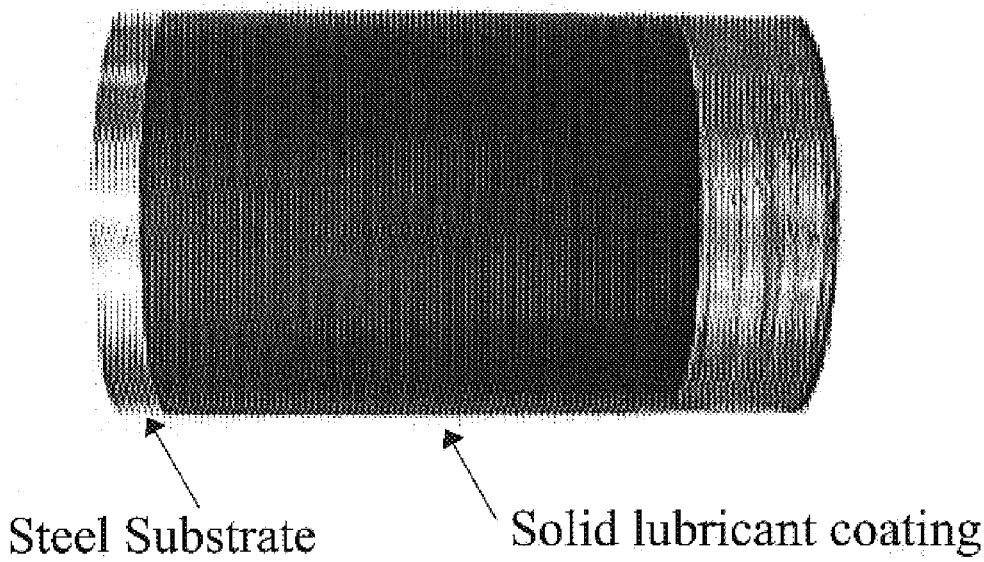
FIG. 4 is a photograph of a steel roller coated with an iron sulfide coating of the present invention.

Coatings having thicknesses in the range of 25 to 500 microns have been made by this procedure. Furthermore, coatings having variable iron sulfide compositions may be produced by varying the thermal spray conditions, as shown in FIG. 2, wherein a coating comprising $FeS_2$ and $Fe_{1-x}S$ is shown.

EXAMPLE 2

1,000 g of FeS was blended with 150 g of 100-mesh sulfur powder. The powder was mixed and ball milled in a milling jar for 24 hours with alumina milling media. The milled powder was placed in the vacuum oven, heated to 120° C. for 24 hours and then cooled to room temperature under vacuum. The cooled powder was then crushed, ball milled to make the particles flowable (i.e., remove the sharp edges from the crushed powder) and sieved to yield agglomerates of sulfur-coated particles Aluminum was selected as the substrate for spraying and was first grit blasted.

The agglomerated powder mixture was then fed into a Metco 6P-II Oxi-Acetylene torch which is a more practical tool for field application. The thickness of the coating was be controlled by the spray cycles. FeS coatings were obtained by using the Metco 6P-II Oxi-Acetylene torch at the spray distance of 3–4 inches, an oxygen/acetylene ratio of 2/1 and powder feeding rate of about 3 pounds per hour. Coatings with good adherence to the substrate were fabricated.

EXAMPLE 3

Using the powder and substrate of example 2, an aluminum bar was sprayed using Plasma gun runs at 200 A, 70 V with argon plasma. The argon flow rate was about 200 SCFH. Coatings with thickness in the range from 50 micron to about 300 microns were manufactured.

EXAMPLE 4

A substrate comprising an alumina-titania wear resistant coating was coated with the coated agglomerates of Example 1, using a plasma gun is operated at 200 A, 70 V using argon plasma, and a powder feeding rate of 3 to about 5 pounds per hour. Coatings with good adherence to the substrate were produced.

EXAMPLE 5

An actual steel roller, 4 inches diameter and 12 inches long, was sand blasted to roughen the surface. A plasma gun was used to deposit an iron sulfide coating with a thickness of 150 microns. The coating had good adherence.

While preferred apparatus and experiment conditions have been shown and described, modifications and substitutions could be made without departing from the spirit and scope of the invention. Accordingly, it is to be understood that the present invention has been described by way of illustration and not limitation.

What is claimed is:

1. A process for producing solid, lubricant coatings, comprising mixing particles comprising a solid lubricant with sulfur to form an agglomerated feedstock powder, wherein the solid lubricant comprises FeS, $MoS_2$, $WS_2$, or mixtures thereof; and thermal spraying the agglomerated feedstock powder onto a substrate to form a coating of the solid lubricant on the substrate.

2. The process of claim 1, wherein the feedstock powder is prepared by ball milling the lubricant particles with a source of sulfur.

3. The process of claim 1, wherein the lubricant particles are nanostructured.

4. The process of claim 1 wherein the thermal spraying uses chemical combustion spraying processes or electric heating spraying processes.

5. The process of claim 1 wherein the thermal spraying is by powder flame spraying, wire/rod flame spraying, high velocity oxygen fuel flame spraying, oxygen acetylene torch spraying, detonation/explosive flame spraying, electric-arc spraying, twin-wire arc spraying, or plasma spraying.

6. The process of claim 1, wherein the substrate is selected from the group consisting of ferrous metal, steels, cast irons, nonferrous metals, aluminum, titanium, nickel alloys, cobalt alloys, aluminum alloys, titanium alloys, ceramics, $Si_3N_4$, SiC, $Al_2O_3$, $Cr_2O_3$, $ZrO_2$, BN, TiC, TiN, WC, WC/Co, diamond, and hard, high temperature plastics.

7. The process of claim 1, wherein the coatings have a porosity in the range of about 5% to about 30% by volume.

8. The process of claim 1, wherein the coatings are from about 1 to about 300 microns thick.

9. The process of claim 1, further comprising heating the agglomerated particles to 50–180 EC for 2 to 24 hours before spraying.

10. The process of claim 1, wherein the solid lubricant comprises FeS.

11. The process of claim 10, wherein the solid lubricant further comprises $FeS_2$.

12. A process for producing solid, lubricant coatings, comprising ball milling particles comprising a solid lubricant with a source of sulfur to form an agglomerated feedstock powder, wherein the lubricant particles comprise FeS $MoS_2$, $WS_2$, or mixtures thereof; and thermal spraying the agglomerated feedstock powder onto a substrate to form a coating of the solid lubricant on the substrate.

13. The process of claim 12 wherein the thermal spraying is by powder flame spraying, wire/rod flame spraying, high velocity oxygen fuel flame spraying, oxygen acetylene torch spraying, detonation/explosive flame spraying, electric-arc spraying, twin-wire arc spraying, or plasma spraying.

14. The process of claim 12 wherein the substrate is selected from the group consisting of ferrous metals, steels, cast irons, nonferrous metals, aluminum, titanium, nickel alloys, cobalt alloys, aluminum alloys, titanium alloys, ceramics, $Si_3N_4$, SiC, $Al_2O_3$, $Cr_2O_3$, $ZrO_2$, BN, TiC, TiN, WC, WC/Co, diamond, and hard, high temperature plastics.

15. The process of claim 12, wherein the coatings have a porosity in the range of about 5% to about 30% by volume.

16. The process of claim 12, further comprising heating the agglomerated particles to 50–180 EC for 2 to 24 hours before spraying.

17. The process of claim 12, wherein lubricant particles are nanostructured.

18. The process of claim 12, wherein the thermal spraying uses chemical combustion spraying processes or electric heating spraying processes.

19. The process of claim 12, wherein the coatings are about 1 to about 300 microns thick.

20. The process of claim 12, wherein the solid lubricant comprises FeS.

21. The process of claim 20, wherein the solid lubricant further comprises $FeS_2$.

* * * * *